US010822778B1

(12) United States Patent
Ling et al.

(10) Patent No.: US 10,822,778 B1
(45) Date of Patent: Nov. 3, 2020

(54) ADJUSTABLE SHOWER HEAD HOLDER WITH SELF-LOCKING STRUCTURE

(71) Applicant: Purity (Xiamen) Sanitary Ware Co., Ltd., Xiamen, Fujian (CN)

(72) Inventors: Xingchuan Ling, Xiamen (CN); Jiayuan Huang, Xiamen (CN); Guozhong Wu, Xiamen (CN); Xiwen Yang, Xiamen (CN)

(73) Assignee: PURITY (XIAMEN) SANITARY WARE CO., LTD., Fujian (CN)

( * ) Notice: Subject to any disclaimer, the term of this patent is extended or adjusted under 35 U.S.C. 154(b) by 42 days.

(21) Appl. No.: 16/386,260

(22) Filed: Apr. 17, 2019

(51) Int. Cl.
*E03C 1/06* (2006.01)

(52) U.S. Cl.
CPC ..... *E03C 1/06* (2013.01)

(58) Field of Classification Search
CPC ..... E03C 1/06; E03C 1/066; F16B 2/18–185; F16B 7/14; F16M 11/046; F16M 13/022; F16M 2200/02; F16M 2200/025; F16M 2200/028
USPC ... 248/125.1, 125.8, 221.11, 222.12–222.13, 248/229.16, 408–409
See application file for complete search history.

(56) References Cited

U.S. PATENT DOCUMENTS

| | | | | |
|---|---|---|---|---|
| 5,632,049 | A * | 5/1997 | Chen | E03C 1/06 248/124.2 |
| 6,774,293 | B2 * | 8/2004 | Hsieh | F16B 2/185 84/327 |
| 7,407,140 | B2 * | 8/2008 | Sen | E03C 1/066 239/283 |
| 7,766,291 | B2 * | 8/2010 | Eilmus | E03C 1/066 248/222.11 |
| 10,694,898 | B2 * | 6/2020 | Wang | E03C 1/06 |
| 10,704,240 | B2 * | 7/2020 | Lin | E03C 1/066 |
| 2019/0218812 | A1 * | 7/2019 | Andrews | E04H 12/2276 |
| 2019/0345700 | A1 * | 11/2019 | Davidson | E03C 1/066 |

* cited by examiner

*Primary Examiner* — David P Angwin
*Assistant Examiner* — Nicholas A Ros
(74) *Attorney, Agent, or Firm* — Leong C. Lei

(57) ABSTRACT

An adjustable shower head holder with a self-locking structure includes a holder body, a lifting rod, a locking assembly, and an operating member. The holder body is movably connected to the lifting rod through the locking component. The operating member is movably fitted to the locking assembly for switching a locked state and an unlocked state of the locking assembly. With a single operation of the operating member, the locked state and the unlocked state of the locking assembly can be changed, thereby positioning or moving the holder body. The operation is simpler. The use is safer.

15 Claims, 6 Drawing Sheets

ADJUSTABLE SHOWER HEAD HOLDER WITH SELF-LOCKING STRUCTURE

BACKGROUND OF THE INVENTION

1. Field of the Invention

The present invention relates to sanitary ware, and more particularly to an adjustable shower head holder with a self-locking structure.

2. Description of the Prior Art

There are two types of shower head holders on the market, one is immovable, which is directly fixed on the wall and cannot be adjusted; the other is movable, which can adjust the height of the shower head holder for different heights of the shower head.

In the sanitary industry, there are two kinds of fixing structures for the adjustable shower head holder. One is to provide a button on the holder for unlocking and locking the locking member inside the holder by pressing and releasing the button, thereby moving and positioning the shower head holder; the other is to provide a rotary knob on the holder to change the tightness of the locking member inside the holder, thereby adjusting the tightness of the locking member to move and position the shower head holder.

The above two structures have drawbacks. The former needs to press the button all the time in the process of moving the shower head holder. The required press force is large and the continuous applied force is required, which cannot be used quickly and easily. As to the latter, in the process of moving the shower head holder, after the locking device is loosened by rotating the rotary knob, the shower head holder will fall due to gravity and must be supported by hand. The whole operation process needs both hands to rotate the rotary knob and hold the shower head holder, respectively. This is also inconvenient for use. The fall of the shower head holder has potential safety hazards such as hitting the user, and it does not meet the needs of people with disabilities.

Accordingly, the inventor of the present invention has devoted himself based on his many years of practical experiences to solve these problems.

SUMMARY OF THE INVENTION

The primary object of the present invention is to provide an adjustable shower head holder with a self-locking structure, which is convenient for adjusting the height of the shower head holder, and is simple in operation and safe in use.

In order to achieve the above object, the present invention adopts the following technical solutions.

An adjustable shower head holder with a self-locking structure comprises a holder body, a lifting rod, a locking assembly, and an operating member. A first passage is defined in the holder body. The lifting rod is insertedly disposed in the first passage. The holder body is provided with a mounting chamber beside the first passage. An included angle is formed between the mounting chamber and the first passage. A first end of the mounting chamber is provided with a first through hole communicating with the first passage. The locking assembly includes a tightening pad and a sliding seat that are sequentially fitted in the first end of the mounting chamber along an axial direction of the mounting chamber. The tightening pad is movably disposed in the first through hole and pressing the lifting rod against a side wall of the first passage. A first return spring is disposed between the tightening pad and a first end of the sliding seat. A first end of the operating member is hingedly connected to a second end of the mounting chamber. Atop of the operating member is provided with a support post. A second end of the sliding seat is formed with a sliding groove. Rotation of the operating member drives a top of the support post to be movably fitted in the sliding groove. The sliding groove has a first position and a second position for fitting the top of the support post. The first position and the second position have a spacing in the axial direction of the mounting chamber. A sliding slope is provided between the first position and the second position.

Preferably, a bottom of the sliding groove is formed with a boss. The first position is located at the boss. The second position is located at the bottom of the sliding groove.

Preferably, the boss is disposed at a middle portion of the bottom of the sliding groove.

Preferably, the boss is provided with a limiting groove for fitting the top of the support post.

Preferably, the locking assembly further includes a locking seat that is movably disposed in the first through hole. The tightening pad is fixed to a first end of the locking seat, facing the lifting rod. The first return spring is disposed between a second end of the locking seat and the first end of the sliding seat. The first through hole is provided with an annular retaining flange protruding inward in a radial direction of the first through hole. An outer periphery of the locking seat is provided with an annular limiting flange protruding outward in a radial direction of the locking seat. A second return spring is provided between the limiting flange and the retaining flange for returning the locking seat.

Preferably, the second end of the locking seat is formed with a first mounting hole. The first end of the sliding seat is provided with a spring fixing post. One end of the first return spring is fitted into the first mounting hole, and another end of the first return spring is fitted onto the spring fixing post.

Preferably, the first end of the operating member is provided with a spherical portion. The support post is formed on a surface of the spherical portion. A support seat and a fixing ring are fixed at an opening of the second end of the mounting chamber. The support seat is provided with a first spherical curved surface. The first spherical curved surface is provided with a strip-shaped through hole through which the support post is inserted and swung. The strip-shaped through hole extends in a direction parallel to the sliding groove. The fixing ring is provided with a second spherical curved surface matching the first spherical curved surface. The fixing ring is provided with a second through hole for insertion of a second end of the operating member. The spherical portion is movably fitted between the first spherical curved surface and the second spherical curved surface.

Preferably, the operating member includes a support member and a handle. The spherical portion is disposed at an end of the handle. A top of the spherical portion is recessed in an axial direction of the handle to form a second mounting hole. One end of the support member is fixed in the second mounting hole by a pin. The support post is formed at another end of the support member.

Preferably, a fixing cover is fitted on the fixing ring. The fixing cover presses the fixing ring and the support seat to be fitted at the opening of the mounting chamber.

Preferably, the fixing cover is screwedly connected to the holder body.

Preferably, the mounting chamber extends in a direction perpendicular to the first passage.

Preferably, the sliding groove extends in a direction parallel to the lifting rod.

Preferably, the support post is disposed along an axial direction of the operating member.

Preferably, a valve core is fixedly connected to an inner wall of the first passage. The valve core is provided with a second passage through which the lifting rod is inserted. The valve core is provided with a third passage corresponding in position to the locking seat. The locking seat is movably disposed in the third through hole. The tightening pad presses the lifting rod against a side wall of the second passage.

Preferably, the holder body is provided with a shower head brace for hanging a shower head. The mounting chamber and the shower head brace are disposed at two sides of the holder body, respectively.

With the above structure, the present invention only needs to operate the operating member at a time for changing the matching position of the support post and the sliding groove to change the spacing between the tightening pad and the sliding seat. The elastic force of the first return spring changes, and the friction between the tightening pad and the lifting rod can be changed, thereby achieving the purpose of positioning or moving the holder body. The operation is simpler. Through the first return spring, there is always friction between the tightening pad and the lifting rod, which can prevent the holder body from sliding downward due to the gravity when in the unlocked state. The use is safer. In addition, through the sliding slope, the operating member is self-locking when in the unlocked state. The unlocked state is not changed, which is convenient for the user to move the holder body.

DETAILED DESCRIPTION OF THE PREFERRED EMBODIMENTS

Figure 1:
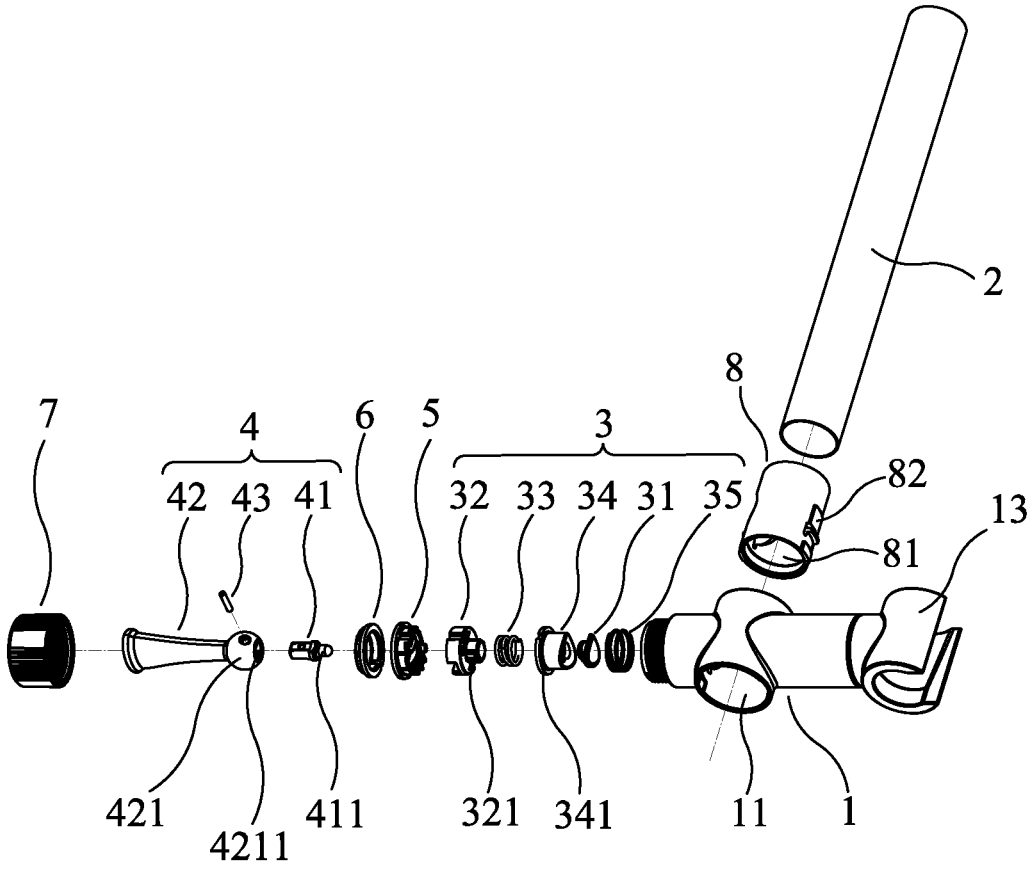
FIG. 1 is a first exploded view according to a specific embodiment of the present invention.
Figure 2:
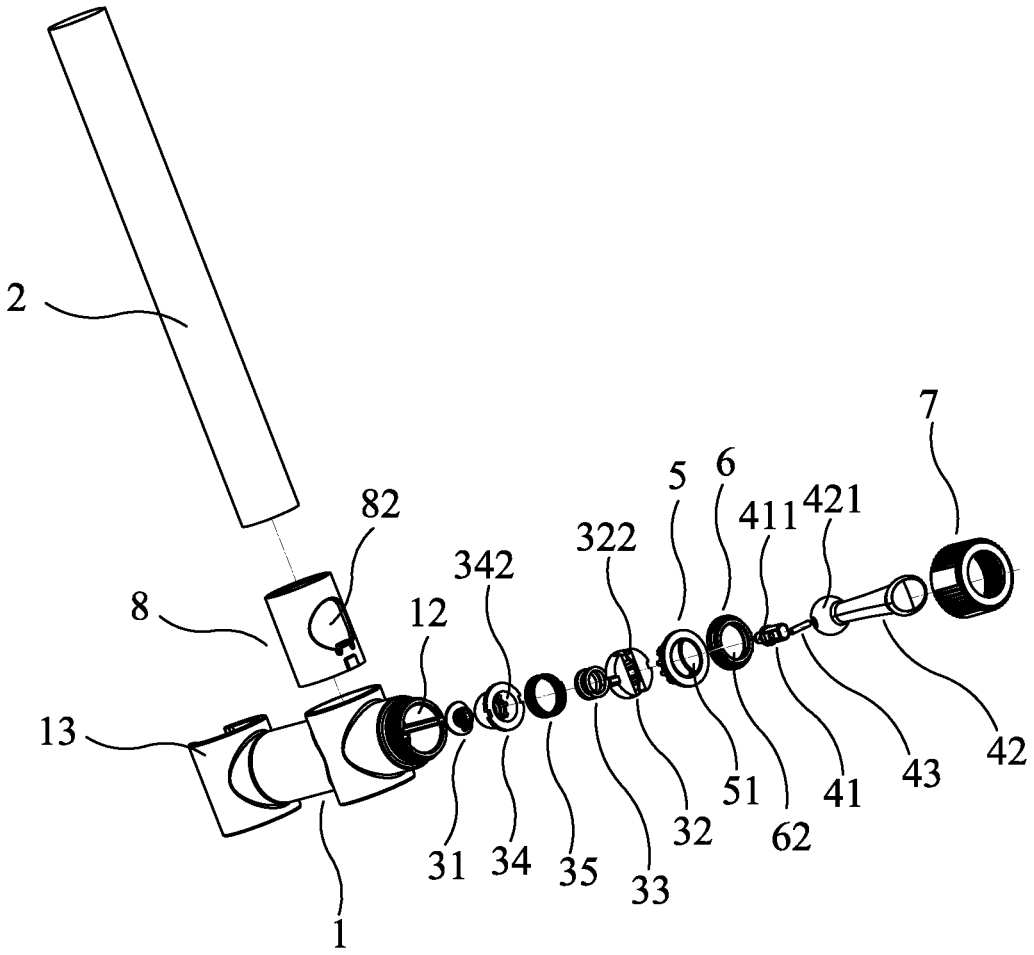
FIG. 2 is a second exploded view according to the specific embodiment of the present invention.

Embodiments of the present invention will now be described, by way of example only, with reference to the accompanying drawings.

As shown in FIG. 1 to FIG. 7, the present invention discloses an adjustable shower head holder with a self-locking structure, comprising a holder body 1, a lifting rod 2, a locking assembly 3, and an operating member 4. The holder body 1 is movably connected to the lifting rod 2 through the locking assembly 3. The locked state and the unlocked state of the locking assembly 3 can be changed by the operating member 4.

A first passage 11 is defined in the holder body 1. The lifting rod 2 is insertedly disposed in the first passage 11. The holder body 1 is provided with a mounting chamber 12 beside the first passage 11. An included angle is formed between the mounting chamber 12 and the first passage 11. In this embodiment, the mounting chamber 12 extends in a direction perpendicular to the first passage 11. A first end of the mounting chamber 12 is provided with a first through hole 121 communicating with the first passage 11.

The locking assembly 3 includes a tightening pad 31 and a sliding seat 32 that are sequentially fitted in the first end of the mounting chamber 12 along the axial direction of the mounting chamber 12. The tightening pad 31 is movably disposed in the first through hole 121 and presses the lifting rod 2 against the side wall of the first passage 11. A first return spring 33 in a compressed state is disposed between the tightening pad 31 and a first end of the sliding seat 32.

In this embodiment, the locking assembly 3 further includes a locking seat 34. The locking seat 34 is movably disposed in the first through hole 121. The tightening pad 31 is fixed to a first end of the locking seat 34, facing the lifting rod 2. The first return spring 33 is disposed between a second end of the locking seat 34 and the first end of the sliding seat 32. The first through hole 121 is provided with an annular retaining flange 1211 protruding inward in the radial direction of the first through hole 121. The outer periphery of the locking seat 34 is provided with an annular limiting flange 341 protruding outward in the radial direction of the locking seat 34. A second return spring 35 is provided between the limiting flange 341 and the retaining flange 1211 for returning the locking seat 34. The second end of the locking seat 34 is formed with a first mounting hole 342. The first end of the sliding seat 32 is provided with a spring fixing post 321. One end of the first return spring 33 is fitted into the first mounting hole 342, and another end of the first return spring 33 is fitted onto the spring fixing post 321. The first return spring 33 is mounted between the locking seat 34 and the sliding seat 32 to ensure the stability of the operation of the first return spring 33.

The tightening pad 31 is generally made of plastic, and the holder body 1 is generally in a positioning state. The first return spring 33 is pressed against the locking seat 34 for a long time, so the tightening pad 31 is easily adhered to the lifting rod 2. When in the unlocked state, the holder body 1 cannot be moved smoothly, so that the second return spring 35 is provided to return the locking seat 34 (i.e., the lock pad 31) toward the sliding seat 32. When the present invention is in the unlocked state, the pressure of the first return spring 33 against the locking seat 34 is reduced, and the second return spring 35 drives the locking seat 34 to move away from the lifting rod 2, so that the tightening pad 31 is slightly separated from the lifting rod 2 to reduce the pressure of the tightening pad 31 against the lifting rod 2.

A first end of the operating member 4 is hingedly connected to a second end of the mounting chamber 12. The top of the operating member 4 is provided with a support post 411 extending along the axial direction of the operating member 4. A second end of the sliding seat 32 is formed with a sliding groove 322. The rotation of the operating member 4 drives the top of the support post 411 to be movably fitted in the sliding groove 322. The sliding groove 322 has a first position 3221 and a second position 3222 for fitting the top of the support post 411. The first position 3221 and the second position 3222 have a spacing in the axial direction of the mounting chamber 12. A sliding slope 3223 is provided between the first position 3221 and the second position 3222. In the locked state, the top of the support post 411 is fitted in the first position 3221. In the unlocked state, the top of the support post 411 is fitted in the second position 3222.

Through the top of the support post 411 to be fitted in the first position 3221 or the second position 3222, the distance between the tightening pad 31 and the sliding seat 32 can be changed, that is, the elastic force of the first return spring 33 can be changed. There are various specific implementations. In this embodiment, the first position 3221 is a boss protruding from a middle portion of the bottom of the sliding groove 322, and the second position 3222 is the bottoms of two ends of the sliding groove 322. The sliding groove 322 extends in a direction parallel to the lifting rod 2. The boss (i.e., the first position 3221) is provided with a limiting groove 3224 for fitting the top of the support post 411 to keep the locked state of the present invention. A second end of the operating member 4 is operated by a user to rotate the operating member 4, so that the support post 411 is swung to change the mating position with the sliding groove 322.

The first end of the operating member 4 is provided with a spherical portion 421. The support post 411 is formed on the surface of the spherical portion 421. A support seat 5 and a fixing ring 6 are fixed at an opening of the second end of the mounting chamber 12. The support seat 5 is provided with a first spherical curved surface 51. The first spherical curved surface 51 is provided with a strip-shaped through hole 511 through which the support post 411 is inserted and swung. The strip-shaped through hole 511 extends in a direction parallel to the sliding groove 322. The fixing ring 6 is provided with a second spherical curved surface 61 matching the first spherical curved surface 51. The fixing ring 6 is provided with a second through hole 62 for insertion of the second end of the operating member 4. The spherical portion 421 is movably fitted between the first spherical curved surface 51 and the second spherical curved surface 61. A fixing cover 7 is fitted on the fixing ring 6. The fixing cover 7 presses the fixing ring 6 and the support seat 5 to be fitted at the opening of the mounting chamber 12. The fixing cover 7 is screwedly connected to the holder body 1. Through the structure that the spherical portion 421 of the operating member 4 is fixed by the support seat 5 and the fixing ring 6, the installation of the operating member 4 and its fixing structure is more convenient, and the disadvantages of difficult positioning and short service life can be avoided.

The operating member 4 includes a support member 41 and a handle 42. The spherical portion 421 is disposed at an end of the handle 42. The top of the spherical portion 421 is recessed in the axial direction of the handle 42 to form a second mounting hole 4211. One end of the support member 41 is fixed in the second mounting hole 4211 by a pin 43. The support post 411 is formed at another end of the support member 41. The support member 41 and the handle 42 may be made of different materials. For example, the support member 41 is made of a plastic material to reduce wear on the sliding seat 32. The handle 42 is made of a metal material to increase the service life of the handle 42 and improve the user experience.

The lifting rod 2 is generally a water pipe arranged vertically in the shower device. Of course, the lifting rod 2 may be an independent rod fixed to the wall for fixing the holder body 1 only.

A valve core 8 is fixedly connected to the inner wall of the first passage 11. The valve core 8 is provided with a second passage 81 through which the lifting rod 2 is inserted. The valve core 8 is provided with a third passage 82 corresponding in position to the locking seat 34. The locking seat 34 is movably disposed in the third through hole 82. The tightening pad 31 presses the lifting rod 2 against the side wall of the second passage 81.

The holder body 1 is provided with a shower head brace 13 for hanging a shower head. The mounting chamber 12 and the shower head brace 13 are disposed at two sides of the holder body 1, respectively.

Figure 3:
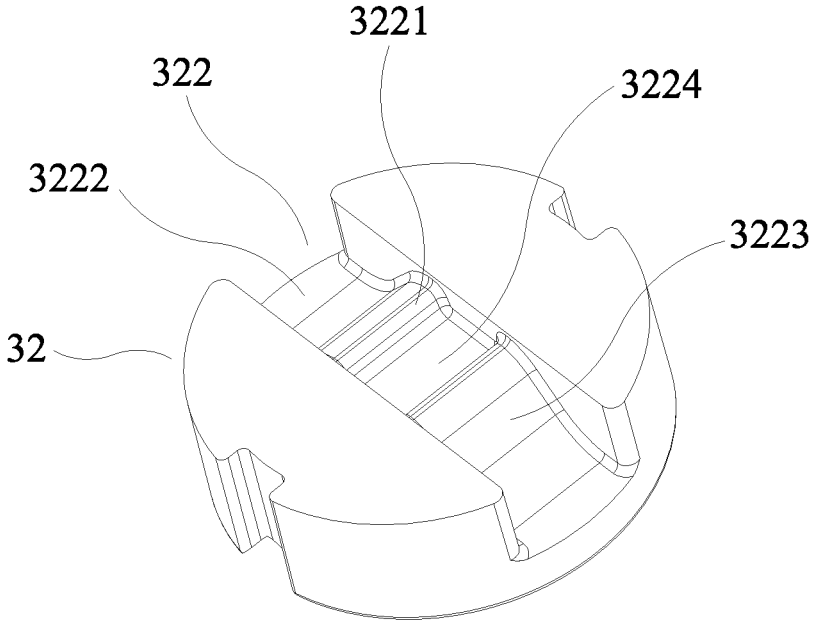
FIG. 3 is a perspective view of the sliding seat according to the specific embodiment of the present invention.
Figure 4:
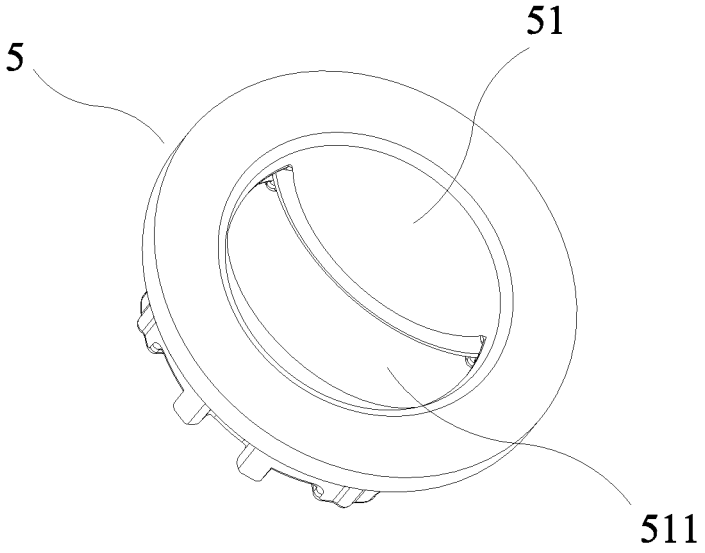
FIG. 4 is a perspective view of the support seat according to the specific embodiment of the present invention.
Figure 5:
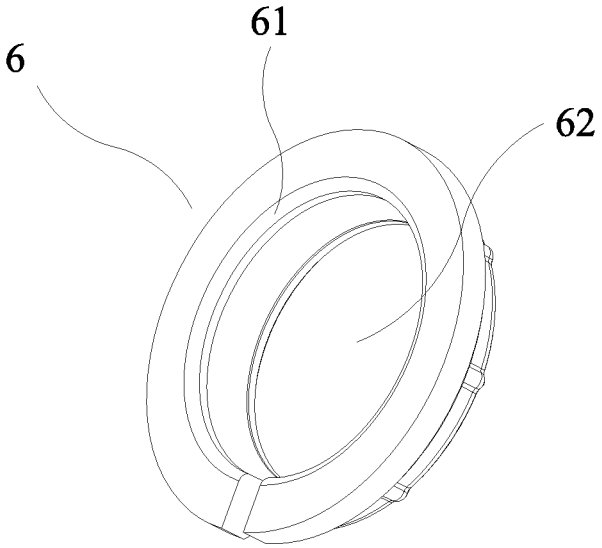
FIG. 5 is a perspective view of the fixing ring according to the specific embodiment of the present invention.
Figure 6:
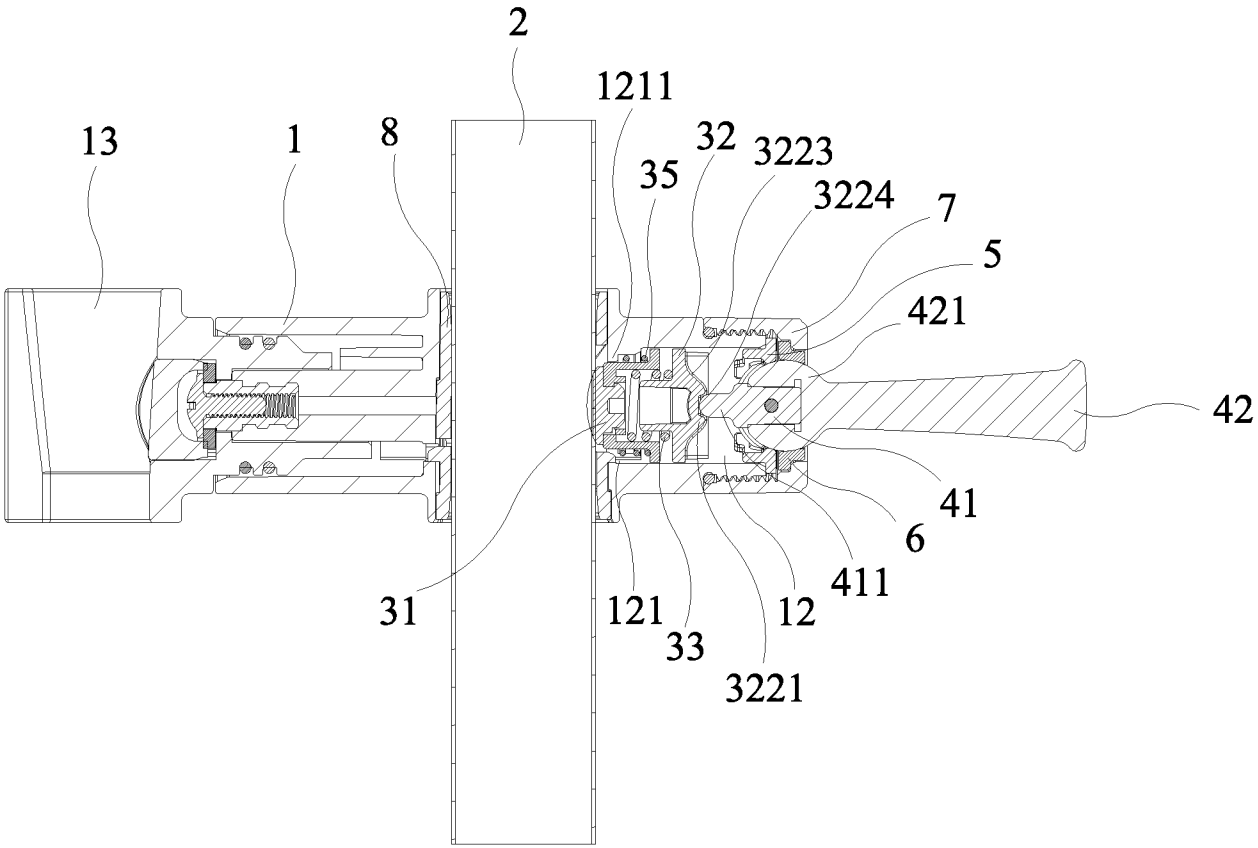
FIG. 6 is a cross-sectional view according to the specific embodiment of the present invention in a locked state.

As shown in FIG. 3 and FIG. 6, when the present invention is in the locked state, the top of the support post 411 is fitted in the limiting groove 3224 to press the sliding seat 32 toward the locking seat 34 to reduce the distance between the two. The first return spring 33 is further compressed, and the elastic force of the first return spring 33 pushes the locking seat 34 toward the lifting rod 2, that is, the pressure of the tightening pad 31 against the lifting rod 2 is increased. According to the friction formula $f=\mu F$ (f is the friction, F is the pressure). The friction between the tightening pad 31 and the lifting rod 2 is increased, so that the holder body 1 is fixed to the lifting rod 2.

Figure 7:
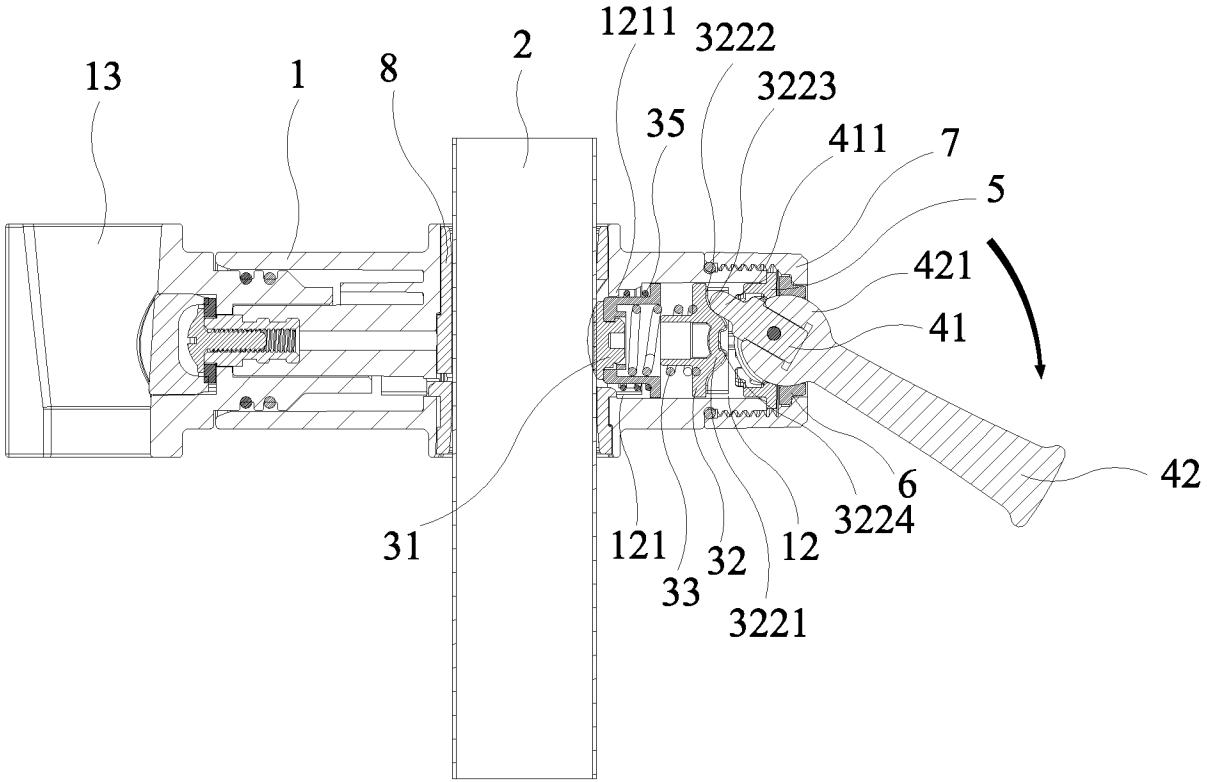
FIG. 7 is a cross-sectional view according to the specific embodiment of the present invention in an unlocked state.

As shown in FIG. 3 and FIG. 7, when the user swings the handle 42 manually, the support post 411 swings with the handle 42. The top of the support post 411 is disengaged from the limiting groove 3224 and is moved along the sliding slope 3223 to the second position 3222, so the present invention is unlocked. Because there is a spacing between the second position 3222 and the first position 3221 in the axial direction of the mounting chamber 12, the sliding seat 32 is moved in a direction away from the locking seat 32. The two ends of the first return spring 33 gradually extend, and the pressure applied to the locking seat 34 is reduced. The locking seat 34 is returned by the second return spring 35 in the direction of the sliding seat 32, so that the tightening pad 31 is slightly separated from the lifting rod 2, and the pressure of the tightening pad 31 against the lifting rod 2 is reduced, that is, the friction between the tightening pad 31 and the lifting rod 2 is reduced. Since the first return spring 33 is still in the compressed state, the tightening pad 31 cannot be completely separated from the lifting rod 2, and there is still friction between the two to prevent the holder body 1 from sliding due to gravity. At this time, as long as the user applies a slight force to overcome the friction (and gravity) between the tightening pad 31 and the lifting rod 2, the holder body 1 can be moved downward (upward).

With the above structure, the present invention only needs a single operation of the operating member 4 for changing the matching position of the support post 411 and the sliding groove 322 to change the spacing between the tightening pad 31 and the sliding seat 32. The elastic force of the first return spring 33 changes, and the friction between the tightening pad 31 and the lifting rod 2 can be changed, thereby achieving the purpose of positioning or moving the holder body 1. The operation is simpler. Through the first return spring 33, there is always friction between the tightening pad 31 and the lifting rod 2, which can prevent the holder body 1 from sliding downward due to the gravity when in the unlocked state. The use is safer. In addition, through the sliding slope 3223, the operating member 4 is self-locking when in the unlocked state. The unlocked state is not changed, which is convenient for the user to move the holder body 1.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. An adjustable shower head holder with a self-locking structure, comprising a holder body, a lifting rod, a locking assembly, and an operating member;

a first passage being defined in the holder body, the lifting rod being insertedly disposed in the first passage;

the holder body being provided with a mounting chamber beside the first passage, an included angle being formed between the mounting chamber and the first passage; a first end of the mounting chamber being provided with a first through hole communicating with the first passage;

the locking assembly including a tightening pad and a sliding seat that are sequentially fitted in the first end of the mounting chamber along an axial direction of the mounting chamber, the tightening pad being movably disposed in the first through hole and pressing the lifting rod against a side wall of the first passage, a first return spring being disposed between the tightening pad and a first end of the sliding seat;

a first end of the operating member being hingedly connected to a second end of the mounting chamber, a top of the operating member being provided with a support post; a second end of the sliding seat being formed with a sliding groove, rotation of the operating member driving a top of the support post to be movably fitted in the sliding groove, the sliding groove having a first position and a second position for fitting the top of the support post, the first position and the second position having a spacing in the axial direction of the mounting chamber, a sliding slope being provided between the first position and the second position.

2. The adjustable shower head holder as claimed in claim 1, wherein the mounting chamber extends in a direction perpendicular to the first passage.

3. The adjustable shower head holder as claimed in claim 1, wherein the sliding groove extends in a direction parallel to the lifting rod.

4. The adjustable shower head holder as claimed in claim 1, wherein the support post extends along an axial direction of the operating member.

5. The adjustable shower head holder as claimed in claim 1, wherein a valve core is fixedly connected to an inner wall of the first passage, the valve core is provided with a second passage through which the lifting rod is inserted, the valve core is provided with a third passage corresponding in position to the locking seat, the locking seat is movably disposed in the third through hole, and the tightening pad presses the lifting rod against a side wall of the second passage.

6. The adjustable shower head holder as claimed in claim 1, wherein the holder body is provided with a shower head brace for hanging a shower head, the mounting chamber and the shower head brace are disposed at two sides of the holder body, respectively.

7. The adjustable shower head holder as claimed in claim 1, wherein a bottom of the sliding groove is formed with a boss, the first position is located at the boss, and the second position is located at the bottom of the sliding groove.

8. The adjustable shower head holder as claimed in claim 7, wherein the boss is disposed at a middle portion of the bottom of the sliding groove.

9. The adjustable shower head holder as claimed in claim 8, wherein the boss is provided with a limiting groove for fitting the top of the support post.

10. The adjustable shower head holder as claimed in claim 9, wherein the locking assembly further includes a locking seat that is movably disposed in the first through hole; the tightening pad is fixed to a first end of the locking seat, facing the lifting rod, the first return spring is disposed between a second end of the locking seat and the first end of the sliding seat; the first through hole is provided with an annular retaining flange protruding inward in a radial direction of the first through hole, an outer periphery of the locking seat is provided with an annular limiting flange protruding outward in a radial direction of the locking seat, and a second return spring is provided between the limiting flange and the retaining flange for returning the locking seat.

11. The adjustable shower head holder as claimed in claim 10, wherein the second end of the locking seat is formed with a first mounting hole, the first end of the sliding seat is provided with a spring fixing post, one end of the first return spring is fitted into the first mounting hole, and another end of the first return spring is fitted onto the spring fixing post.

12. The adjustable shower head holder as claimed in claim 1, wherein the first end of the operating member is provided with a spherical portion, the support post is formed on a surface of the spherical portion; a support seat and a fixing ring are fixed at an opening of the second end of the mounting chamber, the support seat is provided with a first spherical curved surface, the first spherical curved surface is provided with a strip-shaped through hole through which the support post is inserted and swung, the strip-shaped through hole extending in a direction parallel to the sliding groove, the fixing ring is provided with a second spherical curved surface matching the first spherical curved surface, the fixing ring is provided with a second through hole for insertion of a second end of the operating member, and the spherical portion is movably fitted between the first spherical curved surface and the second spherical curved surface.

13. The adjustable shower head holder as claimed in claim 12, wherein the operating member includes a support member and a handle, the spherical portion is disposed at an end of the handle, a top of the spherical portion is recessed in an axial direction of the handle to form a second mounting hole, one end of the support member is fixed in the second mounting hole by a pin, and the support post is formed at another end of the support member.

14. The adjustable shower head holder as claimed in claim 13, wherein a fixing cover is fitted on the fixing ring, and the fixing cover presses the fixing ring and the support seat to be fitted at the opening of the mounting chamber.

15. The adjustable shower head holder as claimed in claim 14, wherein the fixing cover is screwedly connected to the holder body.

* * * * *